US008381469B2

(12) United States Patent
Stal et al.

(10) Patent No.: US 8,381,469 B2
(45) Date of Patent: Feb. 26, 2013

(54) COLD FORMED JOIST

(75) Inventors: Irving Stal, Toronto (CA); Hormoz Sayyad, Richmond Hill (CA)

(73) Assignee: Dizenio, Inc., Concord, Ontario (CA)

( * ) Notice: Subject to any disclaimer, the term of this patent is extended or adjusted under 35 U.S.C. 154(b) by 0 days.

(21) Appl. No.: 13/048,097

(22) Filed: Mar. 15, 2011

(65) Prior Publication Data

US 2011/0247298 A1 Oct. 13, 2011

Related U.S. Application Data

(63) Continuation-in-part of application No. 12/731,518, filed on Apr. 8, 2010.

(51) Int. Cl.
*E04B 5/18* (2006.01)

(52) U.S. Cl. ..... 52/334; 52/636

(58) Field of Classification Search ..... 52/334, 52/289, 634, 636, 745.19, 692, 225.1, 237
See application file for complete search history.

(56) References Cited

U.S. PATENT DOCUMENTS

| | | | | |
|---|---|---|---|---|
| 2,169,253 A | | 8/1939 | Kotrbaty | |
| 2,630,890 A | * | 3/1953 | Macomber | 52/377 |
| 3,332,197 A | * | 7/1967 | Hinkle | 52/844 |
| 3,686,819 A | * | 8/1972 | Atkinson | 52/693 |
| 4,566,240 A | * | 1/1986 | Schilger | 52/414 |
| 5,417,028 A | | 5/1995 | Meyer | |
| 6,993,881 B1 | | 2/2006 | Ruble et al. | |
| 7,257,932 B2 | * | 8/2007 | Ng | 52/634 |
| 7,587,877 B2 | | 9/2009 | Strickland et al. | |
| 2006/0150548 A1 | * | 7/2006 | Bodnar | 52/262 |
| 2010/0037551 A1 | | 2/2010 | Bodnar | |

FOREIGN PATENT DOCUMENTS

| | | | | |
|---|---|---|---|---|
| CA | 900687 | | | 5/1972 |
| CA | 900687 | C | | 5/1972 |
| CA | 2439951 | C | | 1/2003 |
| CA | 2404320 | C | | 11/2003 |
| CA | 2404320 | C | * | 2/2005 |
| CA | 2455071 | A1 | | 5/2005 |
| CA | 2542848 | A1 | | 5/2005 |
| CA | 2667892 | A1 | | 5/2005 |
| CA | 2491194 | A1 | | 6/2006 |
| CA | 2675580 | A1 | | 7/2007 |
| WO | WO-2005/042869 | A1 | | 5/2005 |
| WO | WO 2007082366 | A1 | * | 7/2007 |

* cited by examiner

*Primary Examiner* — Brian Glessner
*Assistant Examiner* — Paola Agudelo
(74) *Attorney, Agent, or Firm* — Miller, Matthias & Hull LLP

(57) ABSTRACT

The present invention provides a cold formed joist that can be used in a variety of construction applications. The present cold formed joist consists of three elements, each formed from sheet metal: an upper chord, an intermediate web, and a lower web. These three elements can be produced in different dimensions. The upper chord further consists of a downwardly facing receiving channel adapted to receive the upper edge of the intermediate web, and two upwardly facing channels. The lower chord consists of an upwardly facing receiving channel that is adapted to receive the lower edge of the intermediate web.

27 Claims, 8 Drawing Sheets

COLD FORMED JOIST

FIELD OF THE INVENTION

The present invention relates to cold formed metal joists for composite and non-composite applications in residential and commercial construction projects.

BACKGROUND OF THE INVENTION

Joists are commonly used in the construction industry to span a distance and provide a surface for a floor, roof or the like. Joists can be comprised of a variety of materials including wood and metal. Metal joists are commonly used in a variety of construction styles as they can be manufactured economically and are light, strong and durable.

Metal joists are commonly fashioned from a piece of sheet metal that is cold formed to desired specifications. Cold forming involves working a material below its recrystallization temperature. Generally, cold forming occurs at the ambient temperature of the work environment. The resultant cold formed material is stronger due to manipulations that have been made to the crystal structure of the material. Cold forming is an economical manufacturing process as it does not require the significant energy input required to raise the material above its recrystallization temperature. Cold forming has the further advantage of providing steel structural components that have increased yield capacity in comparison to steel structural components that have not been cold formed.

Prefabricated metal joists are well-known in the construction industry. However, there is a distinct lack of metal joists that have been designed that can be assembled from a series of differently sized interchangeable parts, such that a metal joist can be adapted to the requirements of any specific application.

Therefore, there is need for a prefabricated metal joist for use in composite and non-composite applications that is light, strong, durable and economically manufactured and can be readily modified depending on the needs of various applications.

BRIEF SUMMARY OF THE INVENTION

The present invention provides a cold formed joist for use in composite and non-composite applications that is constructed of three elements. Each element can be economically manufactured from a single piece of sheet metal. Each element can be produced in different dimensions so the user may select a specific combination of interchangeable sizes in order to produce a cold formed joist that best suits the specific application.

According to the present invention then, there is provided an upper chord for a cold formed metal joist having an upper chord, a lower chord and a web portion disposed therebetween, the upper chord comprising a first longitudinally extending downwardly opening channel formed therein sized and shaped to receive thereinto an upper edge of said web portion; at least one second longitudinally extending upwardly opening channel arranged parallel to said first channel; a flange portion to provide said upper chord with a substantially horizontal load engaging surface.

According to a further aspect of the present invention, there is provided a cold formed metal joist for use in composite and non-composite construction applications, the joist comprising a longitudinally extending upper chord; a longitudinally extending lower chord; and a web portion disposed therebetween; said upper chord comprising a first longitudinally extending downwardly opening channel formed therein sized and shaped to receive an upper edge of said web portion thereinto, a second longitudinally extending, upwardly opening channel disposed on each side of said first channel and a flange portion providing said upper chord with a horizontal load engaging surface, said lower chord comprising a first longitudinally extending upwardly opening channel formed therein sized and shaped to receive a lower edge of said web portion thereinto, said upper and lower edges of said web portion being fixedly connected into said first channels of said upper and lower chords, respectively for a strong load resistant connection thereto.

According to yet another aspect of the present invention, there is provided a method of interconnecting a metal joist for construction applications, the joist having longitudinally extending upper and lower chords and a web portion disposed therebetween, to a hardenable fluid, the method comprising the steps of forming said upper chord to have one or more upwardly opening longitudinally extending channels therein, and forming each of said channels to mechanically interlock with a hardenable fluid poured thereinto to prevent vertical separation between said upper chord and said fluid following the hardening thereof.

According to yet a further aspect of the present invention, there is provided a cold formed metal joist for use in composite and non-composite construction applications, the joist consisting of: a longitudinally extending upper chord formed from of sheet metal, the upper chord consisting of: a downwardly facing U shaped channel, the downwardly facing U shaped channel longitudinally extending along the centerline of the upper chord, the U shaped channel having a curved web portion and a first and second vertical channel wall, the curved web portion having a first and second end, the first vertical channel wall downwardly and vertically extending from the first end of the curved web portion, the second vertical channel wall downwardly and vertically extending from the second end of the curved web portion, the first and second vertical channel wall terminating in a bend; a first and second channel web portion, the first channel web portion projecting outwardly and horizontally from the bend of the first vertical channel wall, the second channel web portion projecting outwardly and horizontally from the bend of the second vertical channel wall, the first and second channel web portion terminating in a bend; a first and second outer channel wall, the first outer channel wall upwardly projecting from the bend of the first channel web portion, the second outer channel wall upwardly projecting from the bend of the second channel web portion, the first and second outer channel wall terminating in a bend; first and second horizontal portion, the first horizontal portion projecting outwardly from the bend of the first outer channel wall, the second horizontal portion projecting outwardly from the bend of the second outer channel wall, the first and second horizontal portion terminating in a bend; a first and second flange, the first flange projecting from the bend of the first horizontal portion, the second flange projecting from the bend of the second horizontal portion; an intermediate web cold formed from sheet metal, the web having an upper folded edge and a lower folded edge; a longitudinally extending lower chord formed from sheet metal, the lower chord having an upwardly facing U shaped channel, the upwardly facing U shaped channel extending longitudinally along the centerline of the lower chord, the upwardly facing U shaped channel having a curved web portion and a first and second vertical channel wall, the first and second channel wall terminating in bends, wherein the upper folded edge of the intermediate web is received in the downwardly projecting U shaped channel of the upper chord and the lower folded edge of the intermediate web is received in the upwardly projecting U shaped channel of the lower chord.

BRIEF DESCRIPTION OF THE DRAWINGS

Preferred embodiments of the present invention will now be described in greater detail and will be better understood when read in conjunction with the following drawings in which.

DETAILED DESCRIPTION OF THE PREFERRED EMBODIMENTS

The cold formed joist of the present invention is contemplated for use in composite and non-composite applications. In composite applications, the cold formed joist can be incorporated directly in a poured concrete slab in a manufacturing facility and delivered to the worksite as a complete assembly for roofing or flooring applications, among other applications. The composite arrangement provides an integral panel and joist assembly that displays excellent strength characteristics, vibration response and load capacity, without unduly stressing the poured concrete panel. It is also contemplated that in certain applications, the integral panel and joist assembly may assembled at the worksite after the cold formed joist has been installed.

Figure 1:
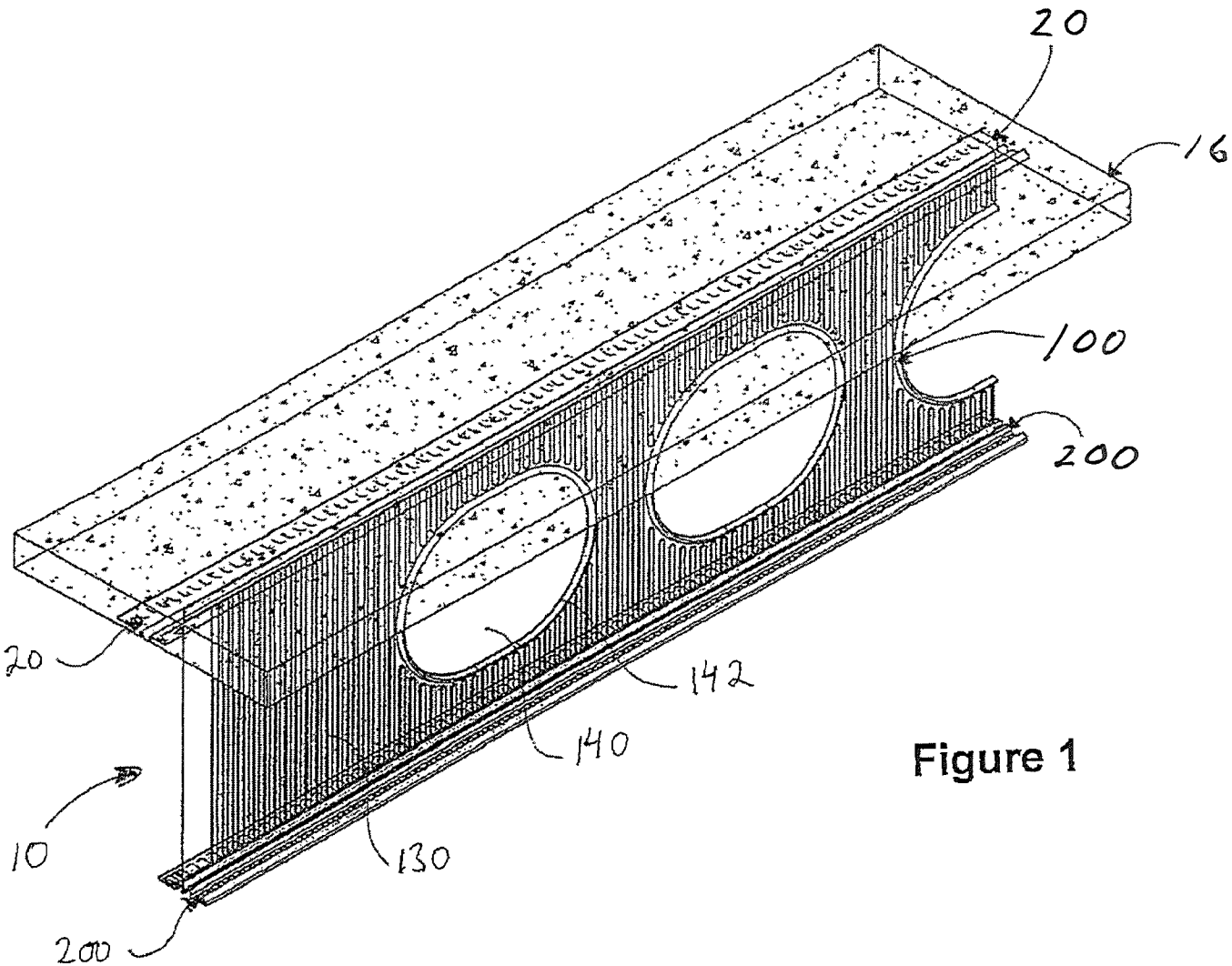
FIG. 1 is a perspective view of a composite joist/panel assembly in accordance with one embodiment of the present invention.

As can be seen in FIG. 1, the present invention may be utilized in composite applications to produce a composite joist/panel assembly that can span larger distances and support greater weights and wherein the joist component is lighter and stiffer in comparison to similar non-composite joist arrangements. Cold formed joist 10 consists of an upper chord 20, an intermediate web 100 and a lower chord 200. Upper chord 20 is embedded directly within a concrete panel 16 in order to provide a composite joist panel assembly.

Alternatively, the cold formed joist can be assembled at the worksite in non-composite applications which employ floor sections, joists, and panels that can be constructed of various materials such as wood, metal, concrete, fibreglass among other materials that will be readily apparent to the skilled person.

Figure 2:
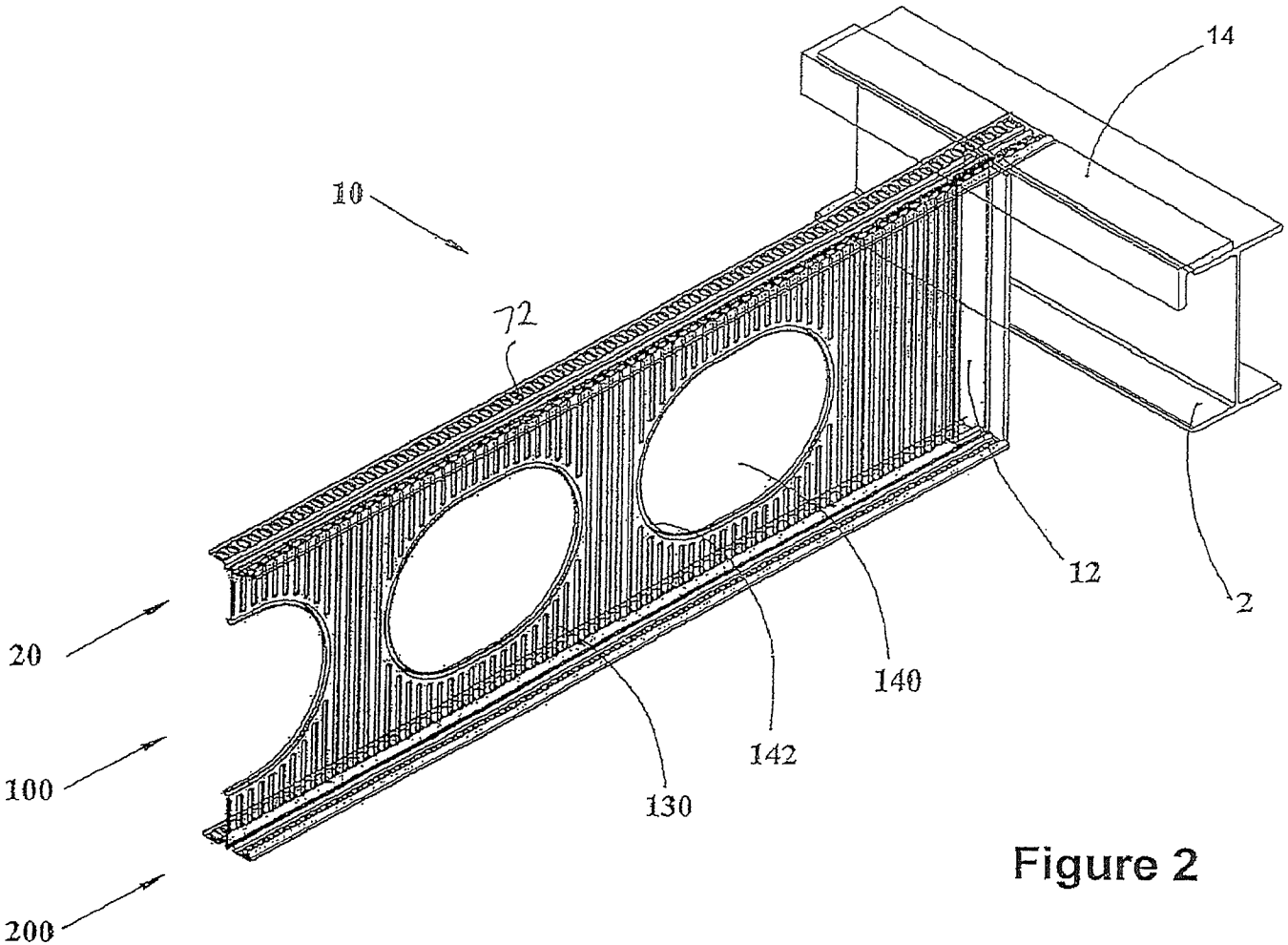
FIG. 2 is a perspective view of one embodiment of the present joist in a non-composite application.

FIG. 2 illustrates a cold formed metal joist in accordance with at least one embodiment of the present invention. Cold formed joist 10 consists of an upper chord 20, an intermediate web 100 and a lower chord 200. In at least one embodiment, each of upper chord 20, intermediate web 100 and lower chord 200 are cold formed from a single piece of sheet metal. The sheet metal may be formed by any process known in the art such as cold rolling stamping among other processes that will be readily apparent to the skilled person. It is also contemplated that upper chord 20 and lower chord 200 can be manufactured from two separate pieces of sheet metal, which will be discussed in further detail below.

The size and thickness of the piece of sheet metal used in manufacturing each of these elements must be sufficient such that the resulting element has the physical properties required for the intended application, the selection of which will be readily apparent to the skilled person in the art.

Each of upper chord 20, intermediate web 100 and lower chord 200 can be formed from a variety of metals, such as but not limited to steel, stainless steel, galvanized steel and aluminium. Each of these components can be formed in various lengths and widths, such that the user may select each element separately to construct a joist suitable for the specific application.

Cold formed joist 10 extends longitudinally between adjacent supports 2. Supports can take any form provided that they are sufficiently strong enough to support the weight of the roof, which typically will consist of a plurality of cold formed joists supporting at least one roof panel. In at least one embodiment, supports 2 may be an I beam as shown in FIG. 2. Suitable roof panels will be readily apparent to the skilled person in the art and may be constructed of a number of materials including corrugated steel, plywood and poured concrete.

Cold formed joist 10 may be secured to supports 2 by any manner known to the skilled person in the art. In the at least one embodiment, cold formed joist 10 can be secured to supports 2 by way of angled plate 12 mounted on intermediate web 100. Angled plate 12 may be formed integrally in intermediate web 100 or alternatively may be attached by welding or any mechanical means. Angled plate 12 can align with a mounting bracket 14 that is secured to support 2 by any suitable means known in the art. Angled plate 12 can then be connected to mounting bracket 14 by way of one or more mechanical fasteners, welding or any other suitable method known to the skilled person.

As can be seen in FIG. 2, in at least one embodiment mounting bracket 14 is a piece of standard angle iron, however it is contemplated that mounting bracket 14 can be manufactured of any suitable material. Mounting bracket 14 may be welded directly to support 2 or alternatively may be fastened to support 2 by any mechanical means which will be readily apparent to the skilled person in the art.

Figure 3:
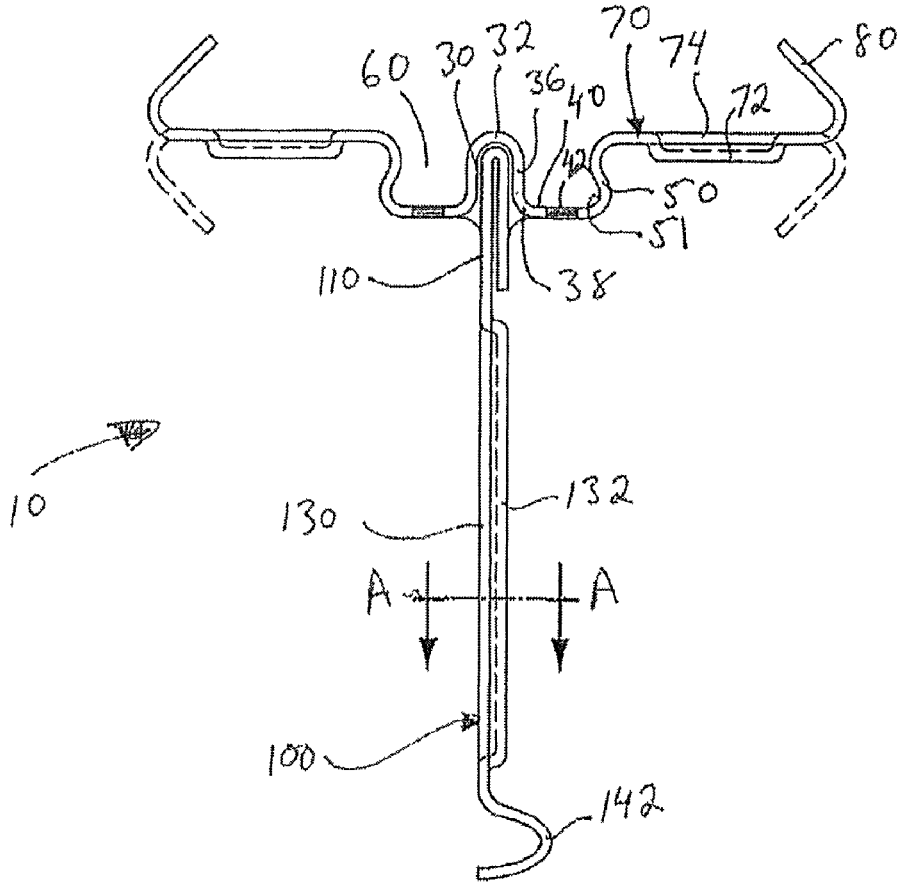
FIG. 3 is a cross-sectional view of one embodiment of an upper chord and the upper part of the intermediate web in accordance with the present joist.
Figure 4:
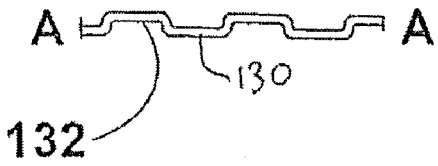
FIG. 4 is a view of section A-A shown in FIG. 3.

Reference will now be made to FIG. 3 which shows upper chord 20 and its connection to web 100 in greater detail. As will be seen in FIG. 3, which shows the upper half of web 100 only, upper chord 20 includes a downward opening receiving channel 30 formed from sheet metal that normally extends longitudinally along the centerline of upper chord 20. Receiving channel 30 can include a curved channel web 32 that extends downwardly into two channel walls 36 forming a channel that is substantially shaped like an upside down U. However, it is contemplated that receiving channel 30 can take other shapes provided that the receiving channel 30 can receive the upper edge 110 of intermediate web 100, which will be described in further detail below.

In at least one embodiment, channel walls 36 extend downwardly and vertically to a point where the sheet metal is bent to form at least one but more typically two (or more) channel web portions 40, which extend outwardly from channel walls 36. In at least one embodiment channel walls 36 and channel web portions 40 are orthogonal to one another, however it is contemplated that the channel wall and the channel web portion can deviate from perfect perpendicularity.

As discussed above, the sheet metal is bent to form channel portions 40 which extend outwardly from the channel walls 36. This bend can be a radial bend 38 as illustrated in FIG. 3, which provides strength without compromising the structural integrity of the sheet metal, however it is also contemplated that this bend could be an edge bend or any other type of bend that would be known to a skilled person in the art. All other bends required in the present invention are analogous to radial bend 38.

Channel web portions 40 extend outwardly from the end of inner channel walls 36 to a point where the sheet metal is bent to form outer channel walls 50. Outer channel walls 50 project upwardly from the distal end of channel web portions 40.

In this way, inner channel walls 36, channel web portions 40 and outer channel walls 50 form two upwardly opening longitudinally extending channels 60 in the top surface of upper chord 20 as seen in FIG. 3. Channels 60 provide stiffness to upper chord 60. In composite applications, concrete can be poured directly into longitudinally extending channels 60. Once the concrete solidifies, the longitudinally extending channels 60 retain the poured concrete panel and restrict any movement between the concrete panel and cold formed joist 10, particularly in the horizontal direction.

In at least one embodiment, outer channel walls 50 project upwardly and inwardly such that longitudinally extending channels 60 are asymmetrically shaped, as seen in FIG. 3 which shows the channels formed with a lower concave bulge 51. Other asymmetrical shapes can be used to accomplish the same end, as can symmetrical configurations such as horizontal corrugations formed in the channel walls. In a further alternative, the channel walls can be formed with stamped or embossed indentations, or even perforations, into which the concrete can set to create an interlock. This arrangement is particularly useful in applications where concrete is poured directly into longitudinally extending channels 60 as the asymmetrical shape of longitudinal extending channels 60 helps to mechanically retain the poured concrete roof panel and restricts any movement between the concrete roof panel and cold formed joist 10 in a vertical direction. However, it is also contemplated that outer channel walls 50 can project upwardly and vertically or alternatively can project upwardly and outwardly depending on the needs of the specific application.

In at least one embodiment, it is contemplated that channel web portions 40, which are the bottom walls of channels 60, can have a series of perforations 42 that are longitudinally spaced apart along channel web portions 40 as can be seen in FIG. 3. Perforations 42 can take any suitable shape and can be formed by any suitable process that will be readily apparent to the skilled person in the art. Perforations 42 allow concrete to be poured into longitudinally extending channels 60 in a manner that eliminates any trapped air bubbles (commonly known as honeycombing) as will be readily appreciated by the skilled person in the art.

Outer channel walls 50 extend upwardly from channel web portions 40 to a point where the sheet metal is bent to form flanges 70. Flanges 70 provide chord 20 with the width required for the intended application and with a horizontal load bearing surface. In a preferred embodiment, each flange 70 includes a horizontal portion 74 that extends laterally outwardly from the upper end of outer channel walls 50, and projecting portion 80 that will be described below.

In at least one embodiment, horizontal portions 74 are stamped or embossed with a series of horizontally spaced apart indentations 72 which extend longitudinally along horizontal portions 74, parallel to the centerline of upper chord 20. Indentations 72 can take any shape and provide further stiffness to upper chord 20 as seen most clearly in FIG. 2. Indentations 72 are a particularly useful feature in applications where a poured concrete roof is desired, as concrete can flow into indentations 72 which helps restrict horizontal movement between the poured concrete panel and cold formed joist 10. In this way, a panel/joist assembly is produced that has superior characteristics to a panel and joist arrangement without this feature.

In at least one embodiment, horizontal portions 74 extend outwardly from the upper end of outer channel walls 50 to a point where the sheet metal is bent to form a pair of projecting flange portions 80. Projecting flanges 80 provide further stiffness to upper chord 20. Projecting flanges 80 can upwardly and inwardly project as shown in FIG. 3, however it is also contemplated that projecting flanges can project in any direction including horizontally, orthogonally, downwardly and inwardly or at any other angle relative to horizontal portions 70.

Figure 5:
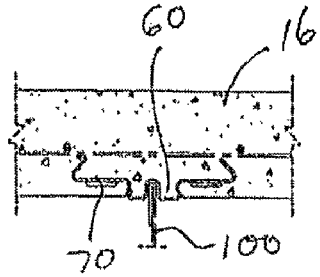
FIG. 5 is a cross sectional partial view of one embodiment of an upper chord and the intermediate web employed in a composite application.

In composite applications used in connection with a poured concrete roof panel, it is most useful to orient projecting flanges 80 upwardly and inwardly as seen in FIGS. 3 and 5, such that projecting flanges 80 are embedded within the concrete panel after it has solidified. Therefore, in this arrangement projecting flanges 80 restrict movement between the concrete panel and cold formed joist 10 in both vertical and horizontal orientations. In non-composite applications where the panel is resting atop chord 20, flanges 80 will normally be bent downwardly and inwardly in a mirror image to the orientation shown in FIG. 3.

Turning back to FIG. 2, at least one embodiment of intermediate web 100 is illustrated. Intermediate web 100 extends longitudinally between adjacent supports 2 and extends vertically between upper chord 20 and lower chord 200.

As shown in FIG. 3, channels 60 are preferably formed immediately laterally adjacent to receiving channel 30 to double up the use of channel walls 36 as one of the walls of channels 60. However, if desired, channels 60 can be spaced apart from receiving channel 36 such as by forming them at some intermediate point along the width of horizontal flanges 70.

Figure 8:
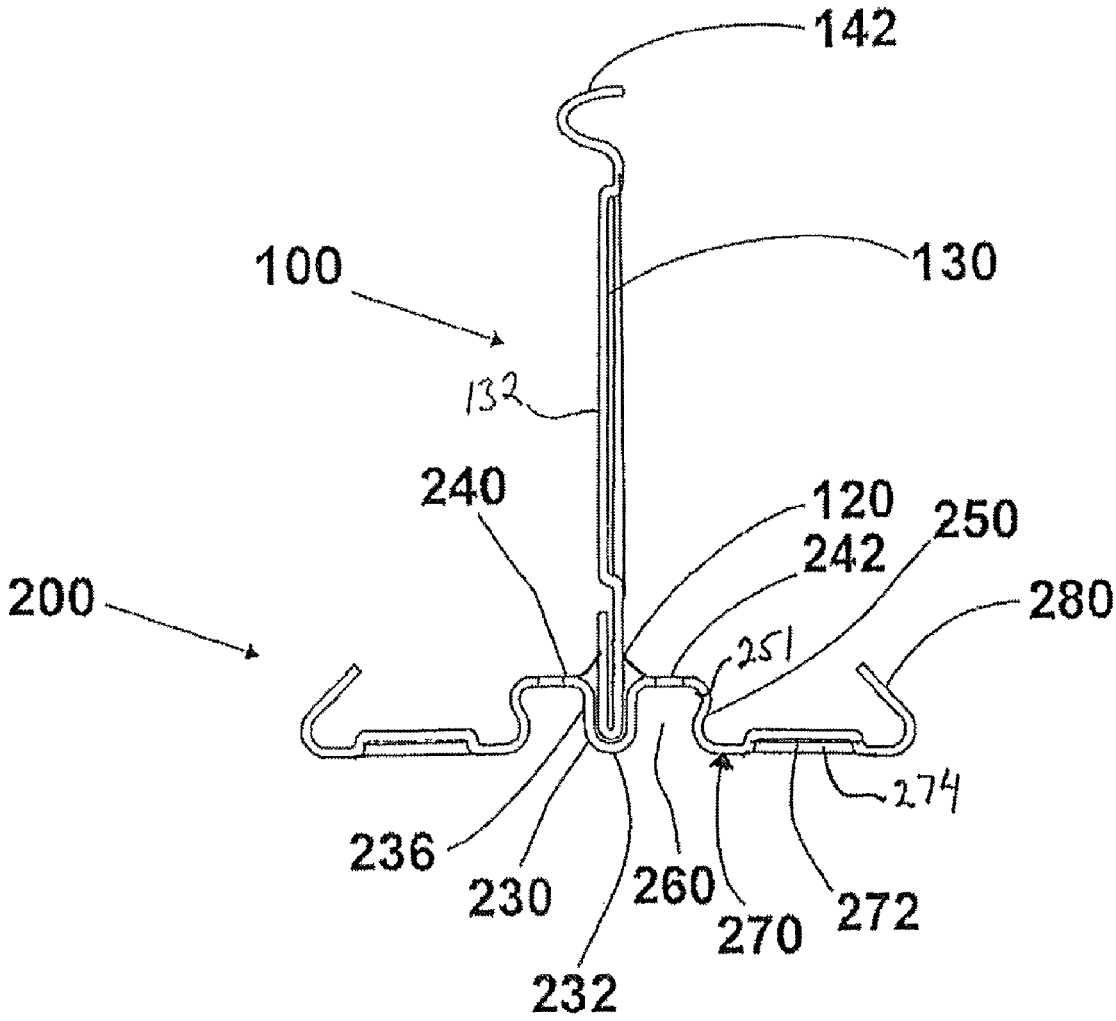
FIG. 8 is a cross-sectional view of one embodiment of a lower chord and the lower part of the intermediate web in accordance with the present joist.

With reference to FIGS. 3 and 8, intermediate web 100 typically consists of an upper folded over edge 110, a lower folded over edge 120 and a central web 130.

Upper folded over edge 110 is a folded section of sheet metal that runs the entire length or substantially the entire length of intermediate web 100. Upper folded edge 110 provides additional stiffness and thickness to intermediate web 100 particularly where it connects to upper chord 20 and can be formed by any suitable process that will be readily apparent to the skilled person in the art.

Upper folded over edge 110 is received in receiving channel 30. In at least one embodiment, receiving channel 30 will be appropriately sized to frictionally retain upper folded edge 110. Upper folded edge 110 will then be further secured within receiving channel 30 and to chord 20 by way of welding or any suitable mechanical means known to the skilled person to provide a strong, secure load resistant connection between them.

Lower folded over edge 120 is analogous to upper folded edge 110 and also provides stiffness and thickness to intermediate web 100 for connection to lower chord 200. Lower folded edge 120 is received in an upwardly facing receiving channel formed in lower chord 200 which will be discussed in further detail below.

As discussed above, upper chord 20, intermediate web 100 and lower chord 200 can be produced in a wide variety of lengths and widths such that cold formed joists of different dimensions can be constructed. However, it is convenient that upper folded over edge 110 and lower folded over edge 120 can be received in the receiving channels of upper chord 20 and lower chord 200 regardless of the dimensions of upper chord 20, intermediate web 100 or lower chord 200. In this way, the individual components of cold formed joist 10 are interchangeable providing a very flexible system that can be adapted to many different applications.

Figures 6, 7:
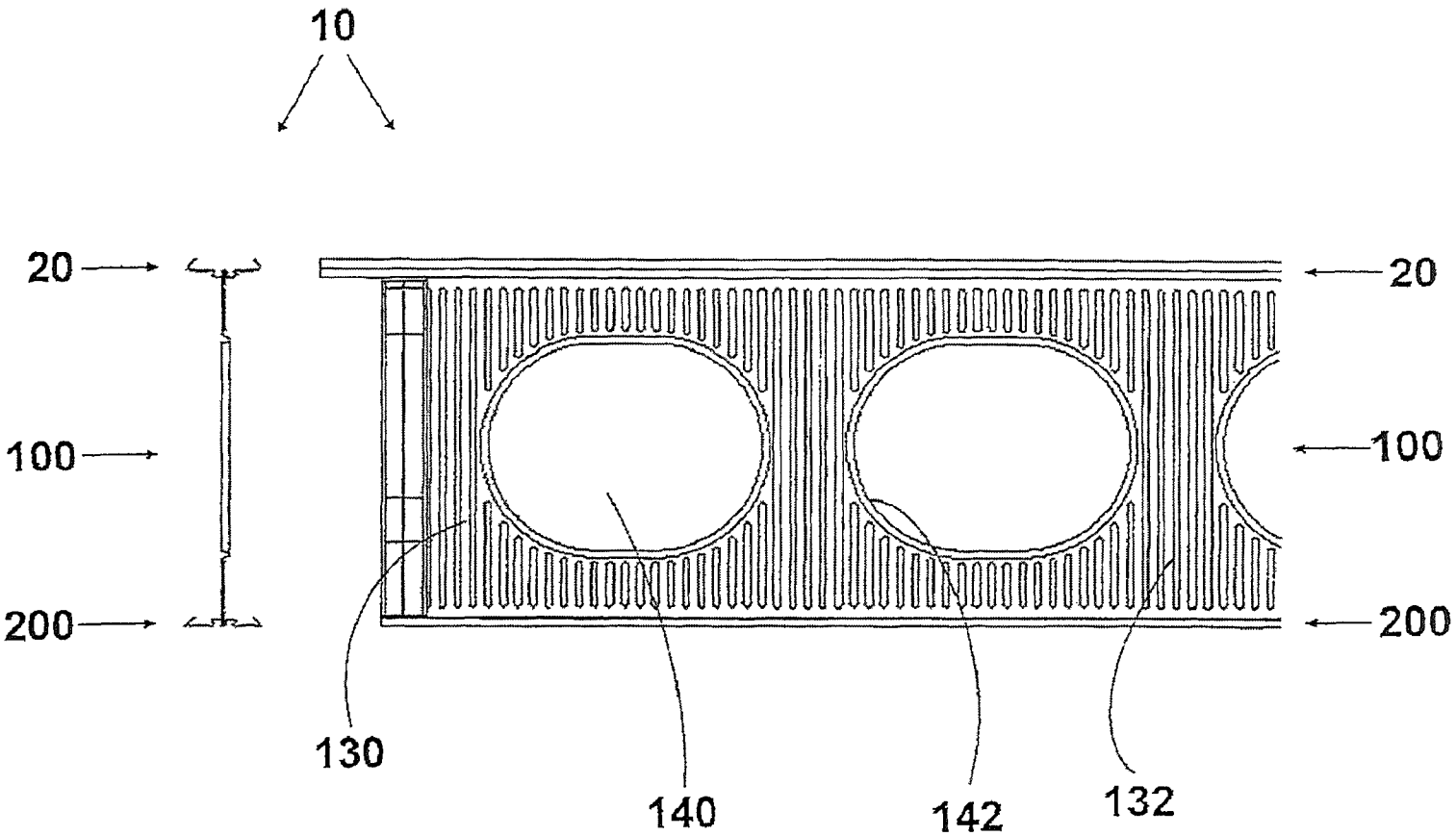
FIG. 6 is a cross-sectional view of one embodiment of the present joist.
FIG. 7 is a side elevational view of the joist shown in FIG. 6.

As seen in FIGS. 2 and 7, in at least one embodiment central web 130 can include a series of stiffening ribs 132 that extend vertically from a point adjacent upper folded over edge 110 to a point adjacent lower folded over edge 120. Stiffening ribs 132 are oriented perpendicularly to upper chord 20 and lower chord 200. Stiffening ribs 132 provide stiffness to intermediate web 100 and can be formed by any suitable process that will be readily apparent to the skilled person in the art such as stamping and embossing, among other processes. In at least one embodiment, stiffening ribs 132 are spaced approximately 1 inch from one another.

As can be seen in FIGS. 2, 7, 10 and 11, in at least one embodiment central web 130 includes a series of web openings 140 that are typically located in a longitudinal line along central web 100. Web openings 140 can take any shape such as obround (as shown), elliptical, circular, square, or even triangular among other shapes that will be readily apparent to the skilled person in the art. As will be appreciated by the skilled person, web openings 140 can be used as access points for electrical wiring, conduits, ducting, plumbing, instrument cables and any other mechanical or electrical services required in residential or commercial construction. Web openings 140 also retard heat transfer between upper chord 20 (which will often be in thermal contact with the roof of the structure) and the lower chord 200. Web openings 140 also reduce the overall weight of cold formed joist 10. In the embodiment illustrated in FIG. 11, web openings 140 are triangularly shaped and oriented in an alternating pattern.

In at least one embodiment, web openings 140 further include a stiffening rim 142 that extends around the perimeter edges of web openings 140. Stiffening rim 142 can take any suitable shape and be formed by any suitable process known to the skilled person in the art. In at least one embodiment, stiffening rim 142 is semi-elliptical in cross section, as can be seen in FIG. 3. The inclusion of stiffening rib 142 provides a cold formed joist that has physical characteristics comparable to a solid joist having no web openings.

Figure 10:
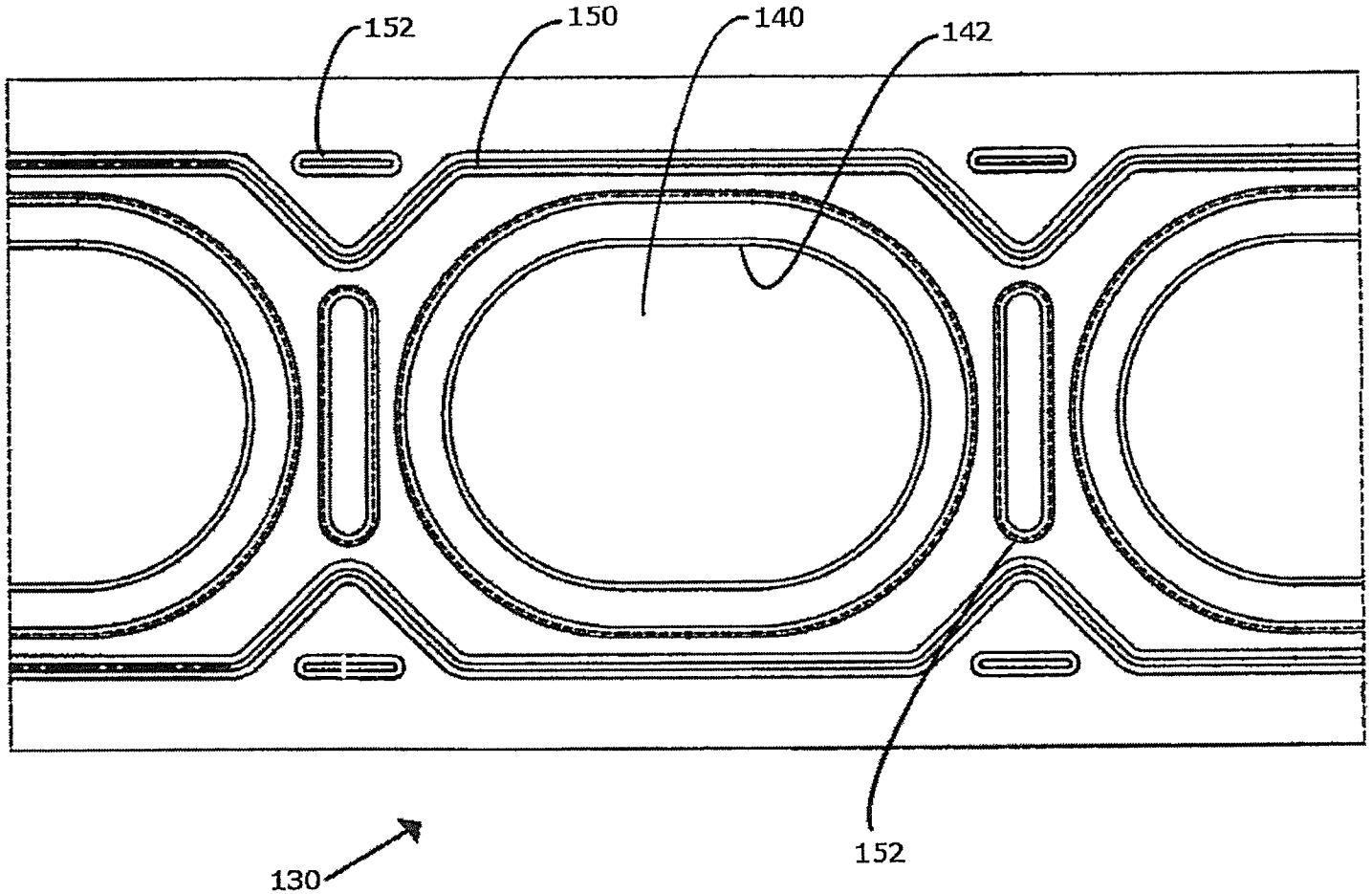
FIG. 10 is a side elevational view of a joist having an alternate web layout in accordance with an alternative embodiment.
Figure 11:
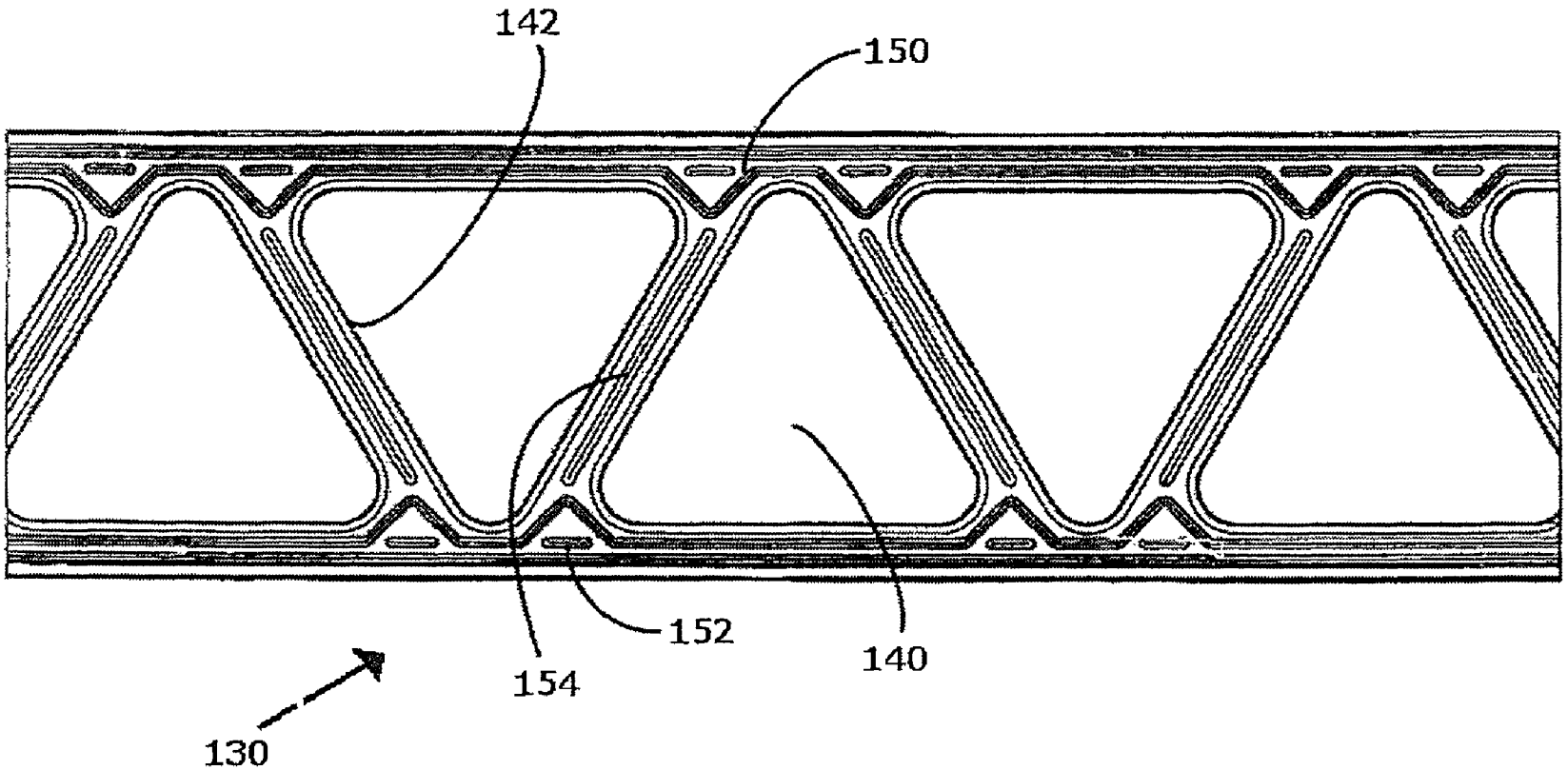
FIG. 11 is a side elevational view of a joist having another alternate web layout in accordance with an alternative embodiment.

With reference to FIGS. 10 and 11, alternative embodiments of central web 130 are illustrated. In these embodiments, central web 130 can further include a series of longitudinally extending stiffening ribs 150, as can be seen in FIGS. 10 and 11. Longitudinally extending stiffening ribs 150 can extend along the central web 130 in any pattern that will depend upon the arrangement of other features of the present invention. In at least one embodiment and as can be seen in FIGS. 10 and 11, longitudinally extending ribs 150 extend in a zig-zag pattern along the upper and lower edges of central web 130 such that longitudinally extending ribs 150 extend parallel in the areas between web openings 140 and the edges of central web 130 and extend angularly toward the centreline of the central web 130 in areas where there is no web opening. Additional stiffening ribs 150 can also be located in the ends of cold formed joist 10.

In at least one embodiment, central web 130 can further include a series of stiffening indentations 152 that can be located in any part of central web 130 that can require additional stiffening, as can be seen in FIGS. 10 and 11. In at least one embodiment, stiffening indentations 152 are located in the area between the angled portions of longitudinally extending stiffening ribs 150. Stiffening indentations 152 can be formed in any shape, including circular, square, rectangular or any other shape that will be readily apparent to the skilled person. Stiffening indentations 152 can be formed with rounded edges to provide further resistance to fatigue failure.

In at least one embodiment, central web 130 can further include a series of transverse stiffening ribs 154 that can that can be located in any part of central web 130 that can require additional stiffening, as can be seen in FIGS. 10 and 11. In at least one embodiment, transverse stiffening ribs 154 are located between adjacent web openings 140. Stiffening ribs 154 are analogous to stiffening indentations 152 in that they can be formed in any shape, including circular, square, rectangular or any other shape that will be readily apparent to the skilled person. As discussed above, stiffening ribs 154 can be formed with rounded edges to provide further resistance to fatigue failure.

With reference to FIG. 8, lower chord 200 can be identical in shape, configuration and construction to upper chord 20, but simply turned upside down, and preferably with flanges 80 turned upwardly and inwardly.

More specifically, lower chord 200 includes an upward opening receiving channel 230 formed from sheet metal that will normally extend longitudinally along the centerline of lower chord 200. Receiving channel 230 can include a curved web section 232 that extends upwardly into two channel walls 236 forming a channel that is substantially shaped like a U. However, it is contemplated that receiving channel 230 can take other shapes provided that the receiving channel 30 can receive lower folded edge 120 of intermediate web 100.

In at least one embodiment, channel walls 236 extend upwardly and vertically to a point where the sheet metal is bent to form channel web portions 240, which extend outwardly from channel walls 236. In at least one embodiment channel walls 236 and channel web portions 240 are orthogonal to one another, however it is contemplated that the channel wall and the channel web portion 240 can deviate from perfect perpendicularity.

Channel web portions 240 extend outwardly from the end of inner channel walls 236 to a point where the sheet metal is bent to form outer channel walls 250. Outer channel walls 250 project downwardly from the distal end of channel web portions 240.

In this way, inner channel walls 236, channel web portions 240 and outer channel walls 250 form two downwardly opening longitudinally extending channels 260 in the top surface of lower chord 200 as seen in FIG. 8. Channels 260 provide additional stiffness to lower chord 200.

In at least one embodiment, outer channel walls 250 project downwardly and inwardly such that channels 260 are asymmetrically shaped, as seen in FIG. 8 which shows a concave bulge 251. However, it is also contemplated that outer channel walls 250 can project downwardly and vertically or alternatively can project downwardly and outwardly depending on the needs of the specific application.

In at least one embodiment, it is contemplated that channel web portions 240 can be formed with a series of spaced apart perforations 242 that are longitudinally placed along channel web portions 240 as can be seen in FIG. 8. Perforations 242 can take any suitable shape and can be formed by any suitable process that will be readily apparent to the skilled person in the art.

Outer channel walls 250 extend downwardly from channel web portions 240 to a point where the sheet metal is bent to form flanges 270. Flanges 270 provide lower chord 200 with the width required for the joist's intended application. Horizontal portions extend outwardly from the upper end of outer channel walls 250. In a preferred embodiment, each flange 270 includes a horizontal portion 274 that extends laterally outwardly from the lower end of outer channel walls 250, and projecting portions 280.

In at least one embodiment, horizontal portions 274 extend outwardly from the lower ends of outer channel walls 250 to a point where the sheet metal is bent to form a pair of projecting flanges 280. Projecting flanges 280 provide further stiffness to lower chord 200. Projecting flanges 280 can upwardly and inwardly project as shown in FIG. 8, however it is also contemplated that projecting flanges 280 can project in any direction including horizontally, upwardly and downwardly, or can be oriented orthogonally to horizontal portions 274 or at any angle relative to horizontal portions 274.

As will be appreciated, upper and lower chords 20 and 200 can be identical in shape, size and configuration for ready interchangeability and to minimize the number of distinct elements making up joist 10. However, lower chord 200 need not be identical to upper chord 20. It can be any other shape or size providing the structural characteristics required for the joist's intended application. For example, as the lower chord is unlikely to be embedded in concrete, it need not have the features of upper chord 20 such as channels 60 and indentations 72 intended to interlock chord 20 with the concrete.

Figure 9:
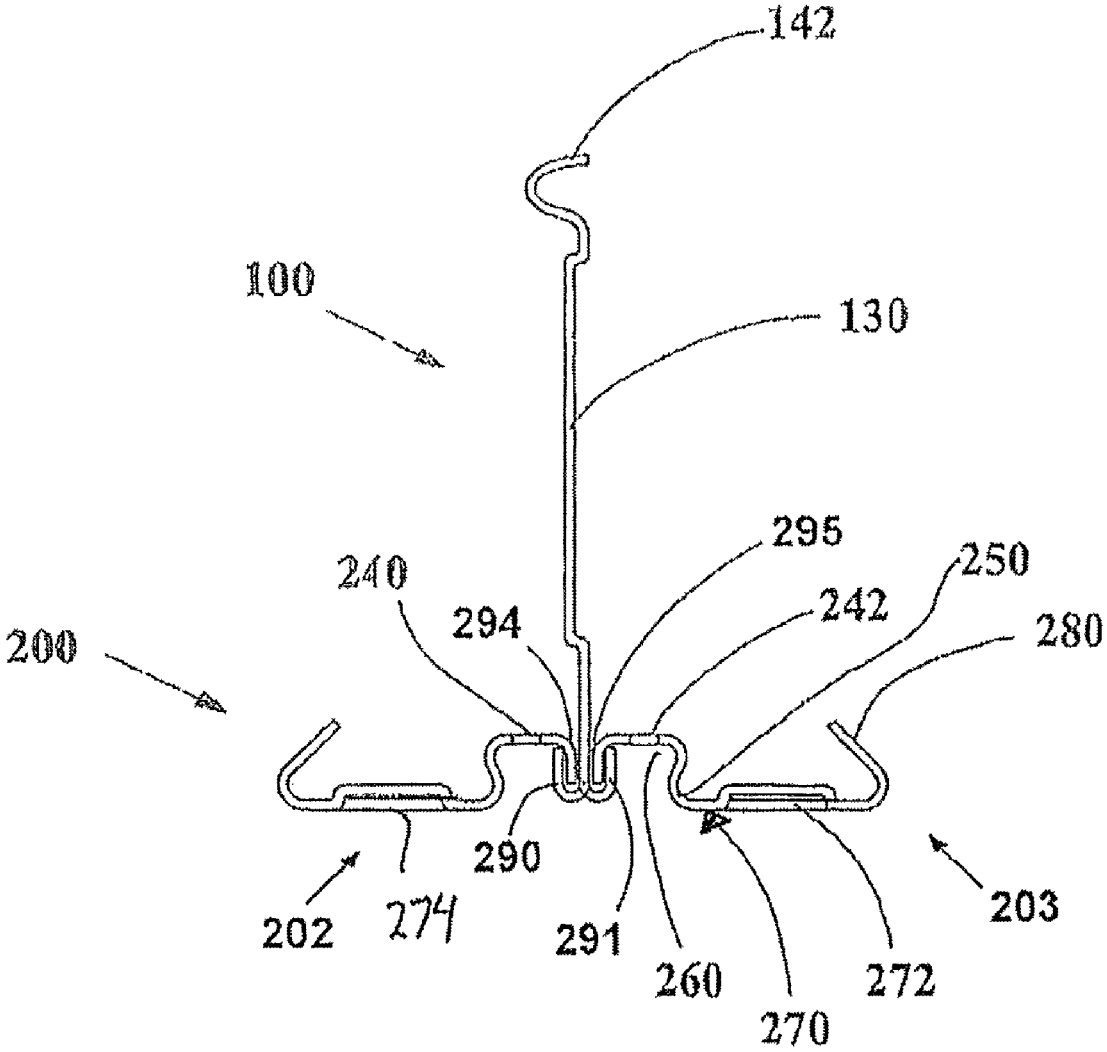
FIG. 9 is a cross-sectional view of a lower chord and intermediate web in accordance with an alternative embodiment of the present joist.

As can be seen in FIG. 9, at least one embodiment lower chord 200 is illustrated which may be constructed in two parts. Two part construction may be employed in both composite and non-composite applications. In this embodiment, lower joist 200 is constructed of a first element 202 and a second element 203. Each of first element 202 and second element 203 includes a first chord tab 294 and a second chord tab 295. Intermediate web 130 is adapted to include a first receiving channel 290 and a second receiving channel 291 which are integrally formed in one end of intermediate web 130 and adapted to receive first chord tab 294 and second chord tab 295. First chord tab 294 and second chord tab 295 may be secured within first receiving channel 290 and second receiving channel 291 by welding or alternatively any mechanical means that will be readily apparent to the skilled person in the art. Upper joist may also be constructed in a two part embodiment as described above. In embodiments employing two part construction, upper and lower joist may include all of the features described above with respect to standard single piece construction.

The above-described embodiments of the present invention are meant to be illustrative of preferred embodiments of the present invention and are not intended to limit the scope of the present invention. Various modifications, which would be readily apparent to one skilled in the art, are intended to be within the scope of the present invention. The only limitations to the scope of the present invention are set out in the following appended claims.

We claim:

1. An upper chord for a cold formed metal joist having an upper chord, a lower chord and a web portion disposed therebetween, the upper chord comprising:

a first longitudinally extending downwardly opening channel formed therein sized and shaped to receive thereinto an upper edge of said web portion, said first longitudinal channel being formed along said chord's longitudinal centre line;

two second longitudinally extending channels each arranged parallel to said first channel, each of said two second channels being disposed on a different side of said first channel, each second channel comprising an upward opening open along the entire longitudinal extent thereof and of sufficient width to directly receive a hardenable fluid applied thereto; and a flange portion to provide said upper chord with a substantially horizontal load engaging surface, wherein said flange portion extends laterally outwardly from each of said two second channels, and wherein said flange portion comprises a first horizontal portion and a second projecting portion bent upwardly at a predetermined angle relative to said horizontal portion;

wherein upon application of the hardenable fluid to the upper chord, the hardenable fluid is received in the upward opening of each second channel and hardens within each second channel to form a hardened fluid, such that movement between the upper chord and the hardened fluid is restricted.

2. The upper chord of claim 1 wherein each said second channel has side walls and an interconnecting bottom wall, wherein at least one of said side walls is formed with a bulge therein for mechanically interlocking with said hardened fluid.

3. The upper chord of claim 2 wherein said bottom wall has a plurality of horizontally spaced apart perforations formed therethrough.

4. The upper chord of claim 3 wherein each of said horizontal portions of said flange portion includes horizontally spaced apart indentations formed therein.

5. A cold formed metal joist for use in composite and non-composite construction applications, the joist comprising:

a longitudinally extending upper chord;

a longitudinally extending lower chord; and a web portion disposed therebetween;

said upper chord comprising:

a first longitudinally extending downwardly opening channel formed therein sized and shaped to receive an upper edge of said web portion thereinto, said first longitudinal channel being formed along said chord's longitudinal centre line;

two second longitudinally extending channels each arranged parallel to said first channel and disposed on a different side of said first channel, each second channel comprising an upward opening open along the entire longitudinal extent thereof and of sufficient width to directly receive a hardenable fluid applied thereto; and a flange portion providing said upper chord with a horizontal load engaging surface, wherein said flange portion extends laterally outwardly from each of said two second channels, and wherein said flange portion comprises a first horizontal portion and a second projecting portion bent upwardly at a predetermined angle relative to said horizontal portion;

said lower chord comprising a first longitudinally extending upwardly opening channel formed therein sized and shaped to receive a lower edge of said web portion thereinto, said upper and lower edges of said web portion being fixedly connected into said first channels of said upper and lower chords, respectively for a strong load resistant connection thereto;

wherein upon application of the hardenable fluid to the upper chord, the hardenable fluid is received in the upward opening of each second channel and hardens within each second channel to form a hardened fluid, such that movement between the upper chord and the hardened fluid is restricted.

6. The joist of claim 5 wherein the metal along said upper and lower edges of said web portion is folded over to increase their thickness.

7. The joist of claim 6 wherein said web portion further includes a plurality of longitudinally spaced apart cold formed stiffening ribs extending vertically from adjacent said upper folded over edge to adjacent said lower folded over edge.

8. The joist of claim 7 wherein said web portion additionally includes a plurality of longitudinally spaced apart openings formed therethrough, said openings being located between said upper and lower folded over edges of said web portion.

9. The joist of claim 8 wherein said openings each have reinforced edges, said reinforced edges being cold formed.

10. The joist of claim 9 wherein said reinforced edges are semi-elliptical in cross-sectional shape.

11. The joist of claim 10 wherein each of said upper and lower chords and said web portion are each cold formed from a unitary piece of sheet metal.

12. The joist of claim 5 wherein said web portion additionally includes a plurality of longitudinally spaced apart openings formed therethrough, said openings being located between said upper and lower folded over edges of said web portion.

13. The joist of claim 12 wherein said openings are triangularly shaped and arranged in an alternating pattern.

14. The joist of claim 13 wherein said openings each have reinforced edges, said reinforced edges being cold formed.

15. The joist of claim 12 wherein said web portion additionally includes at least one longitudinally extending stiffening rib.

16. The joist of claim 15, said at least one longitudinally extending stiffening rib being shaped in a zig-zag pattern.

17. The joist of claim 15 wherein said web portion additionally includes at least one stiffening indentation.

18. The joist of claim 15 wherein said web portion additionally includes at least one transverse stiffening rib.

19. The joist of claim 5 wherein each of said second channels has sidewalls and an interconnecting bottom wall.

20. The joist of claim 19 wherein said bottom wall has a plurality of longitudinally spaced apart perforations formed therethrough.

21. The joist of claim 19 wherein at least one of said sidewalls is formed with a bulge therein for mechanically interlocking with said hardened fluid.

22. The joist of claim 19 wherein said lower chord is substantially identical to said upper chord.

23. A method of interconnecting a metal joist for construction applications to a hardenable fluid, the joist having longitudinally extending upper and lower chords and a web portion disposed therebetween, the method comprising the steps of:

forming said upper chord to have:

a first longitudinally extending downwardly opening channel formed therein sized and shaped to receive thereinto an upper edge of said web portion, said first longitudinal channel being formed along said chord's longitudinal centre line;

two second longitudinally extending channels each arranged parallel to said first channel, each of said two second channels being disposed on a different side of said first channel, each second channel comprising an upward opening open along the entire longitudinal extent thereof and of sufficient width to directly receive a hardenable fluid applied thereto; and a flange portion to provide said upper chord with a substantially horizontal load engaging surface, wherein said flange portion extends laterally outwardly from each of said two second channels, and wherein said flange portion comprises a first horizontal portion and a second projecting portion bent upwardly at a predetermined angle relative to said horizontal portion; and applying the hardenable fluid to the upper chord such that the hardenable fluid is received in the upward opening of each said second channel and hardens within each said second channel to form a hardened fluid, such that movement between the upper chord and the hardened fluid is restricted.

24. The method of claim 23 wherein each of said one or more channels has opposed spaced apart side walls and a lower interconnecting bottom wall.

25. The method of claim 24 wherein the step of forming said upper chord includes forming at least one of said side walls with a longitudinally extending bulge therein for mechanically engaging said hardened fluid.

26. The method of claim 25 wherein the step of forming said upper chord includes forming into said bottom wall a plurality of longitudinally spaced apart perforations for the escape of air during the application of the hardenable fluid, said hardenable fluid being concrete.

27. The method of claim 26 wherein said upper chord is at least partially embedded in said concrete.

* * * * *